US006824440B2

(12) United States Patent
Brener

(10) Patent No.: US 6,824,440 B2
(45) Date of Patent: Nov. 30, 2004

(54) ELEMENT OF ERECTION SET, AND ERECTION SET PROVIDED THEREWITH

(76) Inventor: Alexander Brener, 47-11 12th Ave., Apt. B3, Brooklyn, NY (US) 11219

( * ) Notice: Subject to any disclaimer, the term of this patent is extended or adjusted under 35 U.S.C. 154(b) by 0 days.

(21) Appl. No.: 09/765,756

(22) Filed: Jan. 19, 2001

(65) Prior Publication Data

US 2002/0098769 A1 Jul. 25, 2002

(51) Int. Cl.[7] ..... A63A 33/08

(52) U.S. Cl. ..... 446/124; 446/85; 446/116; 446/120; 446/121; 24/DIG. 41

(58) Field of Search ..... 446/85, 120, 121, 446/124, 125, 127, 128, 116, 115, 101, 106; 403/279, 282, 278, 277, 345; 24/DIG. 41, DIG. 38, 586.11, 618, 619, 662

(56) References Cited

U.S. PATENT DOCUMENTS

| | | | | | |
|---|---|---|---|---|---|
| 2,943,415 | A | * | 7/1960 | Viken | 24/DIG. 41 |
| 3,413,752 | A | * | 12/1968 | Perry | 446/125 |
| 3,479,763 | A | * | 11/1969 | Fischer | 446/124 |
| 3,903,616 | A | * | 9/1975 | Gage | 446/124 |
| 3,921,312 | A | * | 11/1975 | Fuller | 446/116 |
| 3,940,100 | A | * | 2/1976 | Haug | 446/114 |
| 4,147,007 | A | * | 4/1979 | Eppich | 446/114 |
| 4,752,269 | A | * | 6/1988 | Feinstein | 446/124 |
| 5,183,430 | A | * | 2/1993 | Swann | 446/115 |
| 5,486,127 | A | * | 1/1996 | Wolfe | 24/DIG. 41 |
| 5,501,626 | A | * | 3/1996 | Harvey | 446/104 |
| 5,593,337 | A | * | 1/1997 | Lapointe | 446/125 |
| 5,762,530 | A | * | 6/1998 | Zheng | 446/114 |
| 5,833,512 | A | * | 11/1998 | Nicola | 446/114 |
| 5,853,313 | A | * | 12/1998 | Zheng | 446/106 |
| 5,910,038 | A | * | 6/1999 | Zheng | 446/114 |
| 5,938,496 | A | * | 8/1999 | Zheng | 446/106 |
| 6,116,980 | A | * | 9/2000 | Bauer et al. | 446/104 |
| 6,116,981 | A | * | 9/2000 | Zheng | 446/106 |
| 6,186,855 | B1 | * | 2/2001 | Bauer et al. | 446/104 |
| 6,234,858 | B1 | * | 5/2001 | Nix | 446/97 |
| 6,250,986 | B1 | * | 6/2001 | Sorensen | 446/127 |
| 6,398,121 | B1 | * | 6/2002 | Morgan | 238/10 F |

FOREIGN PATENT DOCUMENTS

| | | | | | |
|---|---|---|---|---|---|
| DE | 2947894 | A | * | 7/1981 | A63H/33/06 |
| DE | 3900816 | A | * | 7/1990 | A63H/33/08 |
| DE | 3928127 | A1 | * | 1/1991 | E04B/2/06 |
| EP | 463125 | B1 | * | 5/1995 | A63H/33/04 |

* cited by examiner

*Primary Examiner*—Derris H. Banks
*Assistant Examiner*—Urszula M Cegielnik

(57) ABSTRACT

An element of an erection set has a body provided with a rigid projection and a flexible plate spaced from one another so as to form a gap therebetween such that a width of the gap between ends of the projection and the plate is greater than a width of the gap between tops of the rigid projection and the flexible plate is greater than a width of the gap between bottoms of the rigid projection and the flexible plate, and the plates of at least two of such elements are engageable with one another and displaceable relative to one another due to equalization of stresses formed by deformation of the flexible plate during displacement of the flexible plates over the rigid projections of two elements relative to one another and bending of the flexible plates over a surface of the rigid projections during connection of two elements with one another.

8 Claims, 11 Drawing Sheets

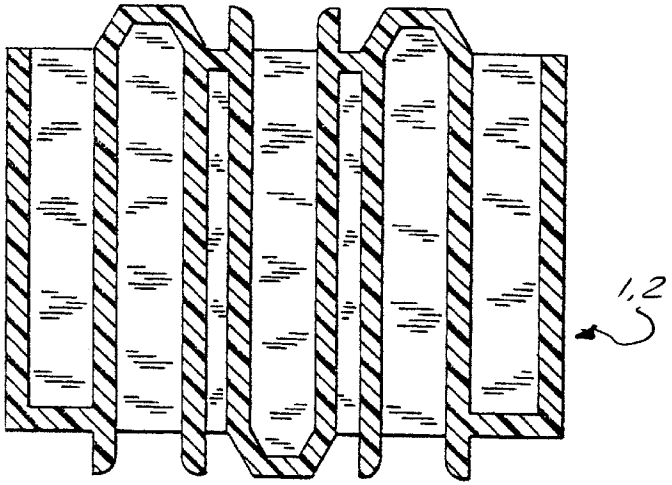
FIG. 7C
FIG. 7A
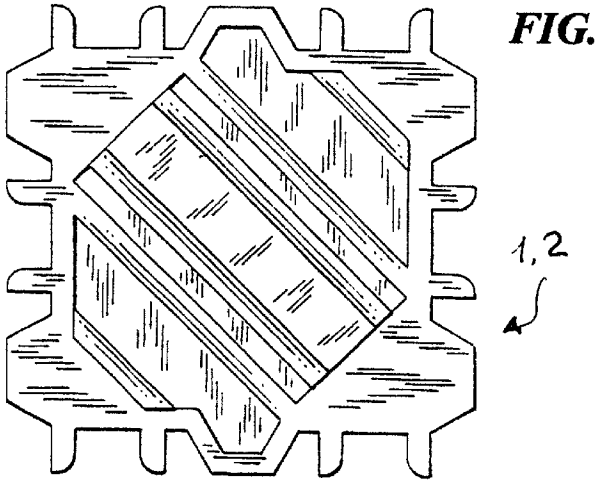
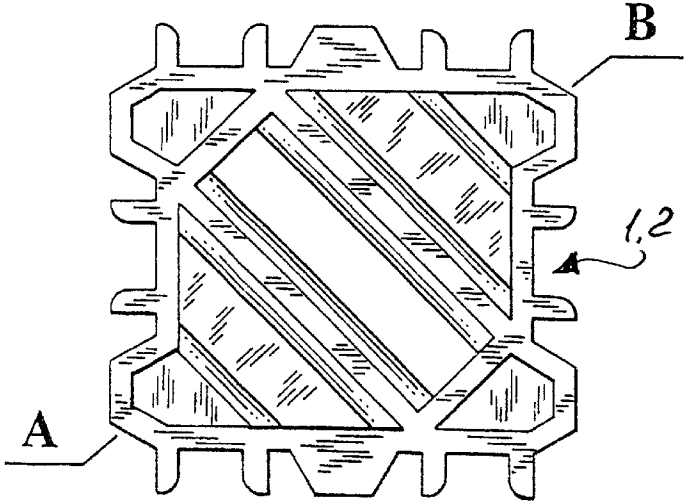
FIG. 7B

ELEMENT OF ERECTION SET, AND ERECTION SET PROVIDED THEREWITH

BACKGROUND OF THE INVENTION

The present invention relates to an element of erection set, and erection set provided therewith.

Erection sets are known, which includes elements formed as prisms with four-cornered or triangular sides. Projections of identical thickness with gaps therebetween are formed on the sides of the elements. The ends of the projections have thickened portions oriented toward the gaps. Opposite to the thickenings, there are recesses on the opposite ends of the projections. When the elements is connected with one another, the thickenings on the ends of one block coincide with the recesses of the other block and are fixed in them. This is disclosed for example in U.S. Pat. No. 4,886,477. This construction has a disadvantage that it is necessary to make the projections and gaps with a high accuracy, which is possible only with the use of highly stable, high grade plastic materials. Also, the erection set is complicated for forming production equipment, since the projection has a complicated shape.

Another set is disclosed in Russian patent document RU2048842. Each element has a box-shaped body with a bottom and side walls, and the projections and gaps formed by a group of cantilevered elements which are flexible. The cantilevered elements are engageable with one another to deform each other. The disadvantage of this erection set is that the elements have only two opposite surfaces for interengagement, which reduces the versatility of the set for various combinations.

Still another set is disclosed in the German patent document DE 1156688. Here the elements have alternating projections and gaps with rigid projections have shaped sides, and flexible projections. The flexible plates are used to connect the elements with one another, and they are arranged symmetrically in the gaps formed in the elements. For connection of the elements the flexible tongues are introduced into the gaps between the surfaces of the rigid elements. The disadvantage of this set is that the flexible tongues extend beyond the surface of the elements thus forming the connecting surface unstable and non usable as a base, and also the projecting part of the flexible plate can be broken. Also, the tendency of the bent flexible tongues to return to the initial position can lead to the displacement of the blocks relative to one another and inaccurate engagement of their surfaces.

SUMMARY OF THE INVENTION

Accordingly, it is an object of the present invention to provide an element, and an erection set which avoids the disadvantages of the prior art.

More particularly, it is an object of the present invention to provide such an element and an erection set, in which the elements have several connectable surfaces which reliable and convenient elements for interengagement, so that the assembly can be made faster and more convenient, and so that the constructions to be assembled are more versatile, with simultaneous increase of the reliablity of connections of the blocks and accuracy of their interengagement.

In keeping with these objects and with others which will become apparent hereinafter, one feature of present invention resides, briefly stated, in an element which has a body provided with a rigid projection and a flexible plate spaced from one another so as to form a gap therebetween such that a width of said gap between ends of said projection and said plate is greater than a width of said gap between tops of said rigid projection and said flexible plate is greater than a width of said gap between bottoms of said rigid projection and said flexible plate, and said plates of at least two of such elements are engageable with one another and displaceable relative to one another due to equalization of stresses generated by deformation of said flexible plate during displacement of said flexible plates over said rigid projections of two elements relative to one another and bending of said flexible plates over a surface of said rigid projections during connection of two elements with one another.

In accordance with another feature of present invention said width of said gap between said bottoms of said flexible plate and said rigid projection corresponds to or less than a thickness of said flexible plate.

In accordance with another feature of present invention said width of said gap between said bottoms of said flexible plate and said rigid projection is less than a width of said flexible plate.

In accordance with another feature of present invention a second such flexible plate is provided, said rigid projections being located between said flexible plates.

In accordance with another feature of present invention said flexible plates and said rigid projection is formed so that when two elements are connected with one another, each of said flexible plates, with the exception of extreme flexible plates, of one of the elements is located between sides of said flexible plate and said rigid projection of the other of the elements.

In accordance with another feature or present invention said flexible plate and said rigid projection are formed so that when two elements are connected with one another, said rigid projection of one element is located between two flexible plates of the other element.

In accordance with a further feature of present invention, a set is proposed which has a plurality of elements each having a body provided with a rigid projection and a flexible plate spaced from one another so as to form a gap therebetween such that a width of said gap between ends of said projection and said plate is greater than a width of said gap between tops of said rigid projection and said flexible plate is greater than a width of said gap between bottoms of said rigid projection and said flexible plate, and said plates of at least two of such elements are engageable with one another and displaceable relative to one another due to equalization of stresses formed by deformation of said flexible plate during displacement of said flexible plates over said rigid projections of two elements relative to one another and bending of said flexible plates over a surface of said rigid projections during connection of two elements with one another.

In accordance with still a further feature of present invention each of said elements has a side surface which has a shape selected from the group consisting of a rectangular shape and a parallelogram shape.

In accordance with still a further feature of present invention each of said element has a triangular surfaces having edges between sides selected from the group consisting of equal angles and unequal angles.

In accordance with still a further feature of present invention said flexible tongue and said rigid projection is provided on each sides of said elements.

In accordance with still a further feature of present invention said flexible tongues and said rigid projections are formed on sides of said element with an orientation relative to one of an edge of said sides selected from the group consisting of a perpendicular orientation, a parallel orientation and orientation with different angles.

In accordance with still a further feature of present invention said elements have a shape selected from the group consisting of a four-sided prism, and a three sided truncated prism.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 7*a*, 7*b* and 7*c* show two further elements and their cross-section;

DESCRIPTION OF THE PREFERRED EMBODIMENTS

Figure 1:
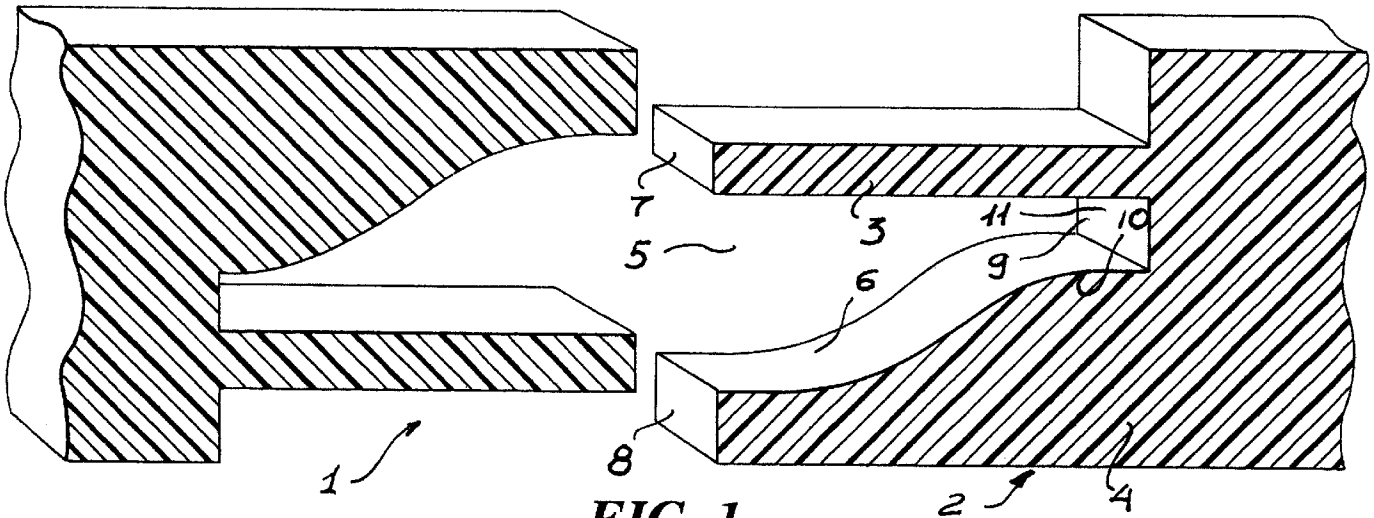
FIG. 1 is a view showing two elements of a set in accordance with the present invention before their assembly.
Figure 2:
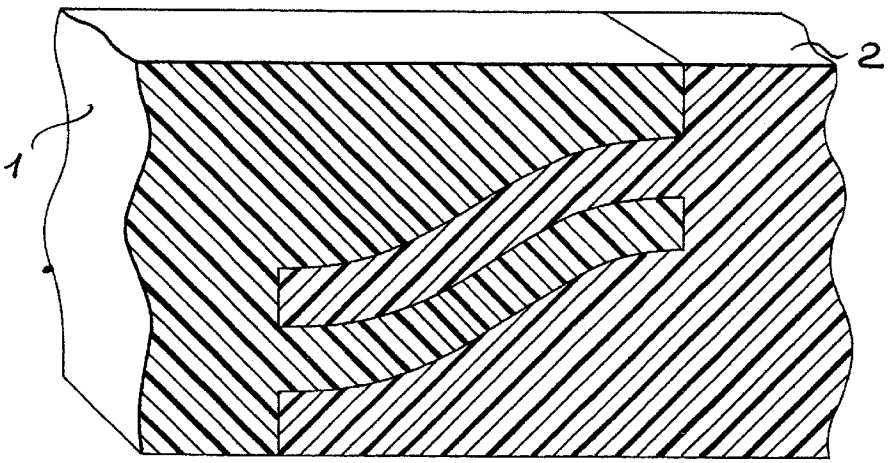
FIG. 2 is a view showing the same two elements which are assembled with one another.

An erection set has a plurality of elements which are identified in FIGS. 1 and 2 with reference numerals 1 and 2. Connecting elements are arranged on the elements 1 and 2 and formed as a flexible plate 3 and a rigid projection 4. A gap 5 is formed between the flexible plate 3 and the rigid projection 4. A side surface 6 of the rigid projection 4 is shaped, so that a width of the gap 5 between the tops 7 and 8 of the flexible plate 3 and the rigid projection 4 is greater than its width between bottoms 9 and 10 of the same, approximately 1-5–2.5 times. The width of the gap between the bottoms 9 and 10 can correspond to a thickness of the flexible tongue 3 or can be less than this thickness.

The profile of the surface 6 provides a smooth transition from the beginning of the gap to its bottom 11, and also a smooth reduction of the width of the path from its beginning to its bottom 11. It depends on a shape of the curve which forms the side surface 6. The shape of a cross-section of the rigid projection 4 is trapezoidal with curved side surfaces. The flexibility of the flexible plate 3 is determined by its thickness and property of the material, from which the elements are made. The rigidity of the rigid projection 4 is determined by its thickness and also by the shape of a cross-section which is thickened toward the bottom.

The flexible plates 3 and the rigid projections 4 are arranged on the surface of the elements 1 or 2 parallel to one another, so as to alternate. For example, one rigid projection can alternate with two flexible plates. The flexible plates 3 and the rigid projection 4 have an elongated shape. Preferably, the length of the structure 3 and 4 corresponds to the length of the side of the element. However, it can be a different one, for example greater or smaller than the length of the element. The top 7 and 8 of the flexible tongues 3 and the rigid projections 8 are located in the same plane, so that they form a surface of the element, and therefore the element is stable and convenient for assembly.

Figure 9:
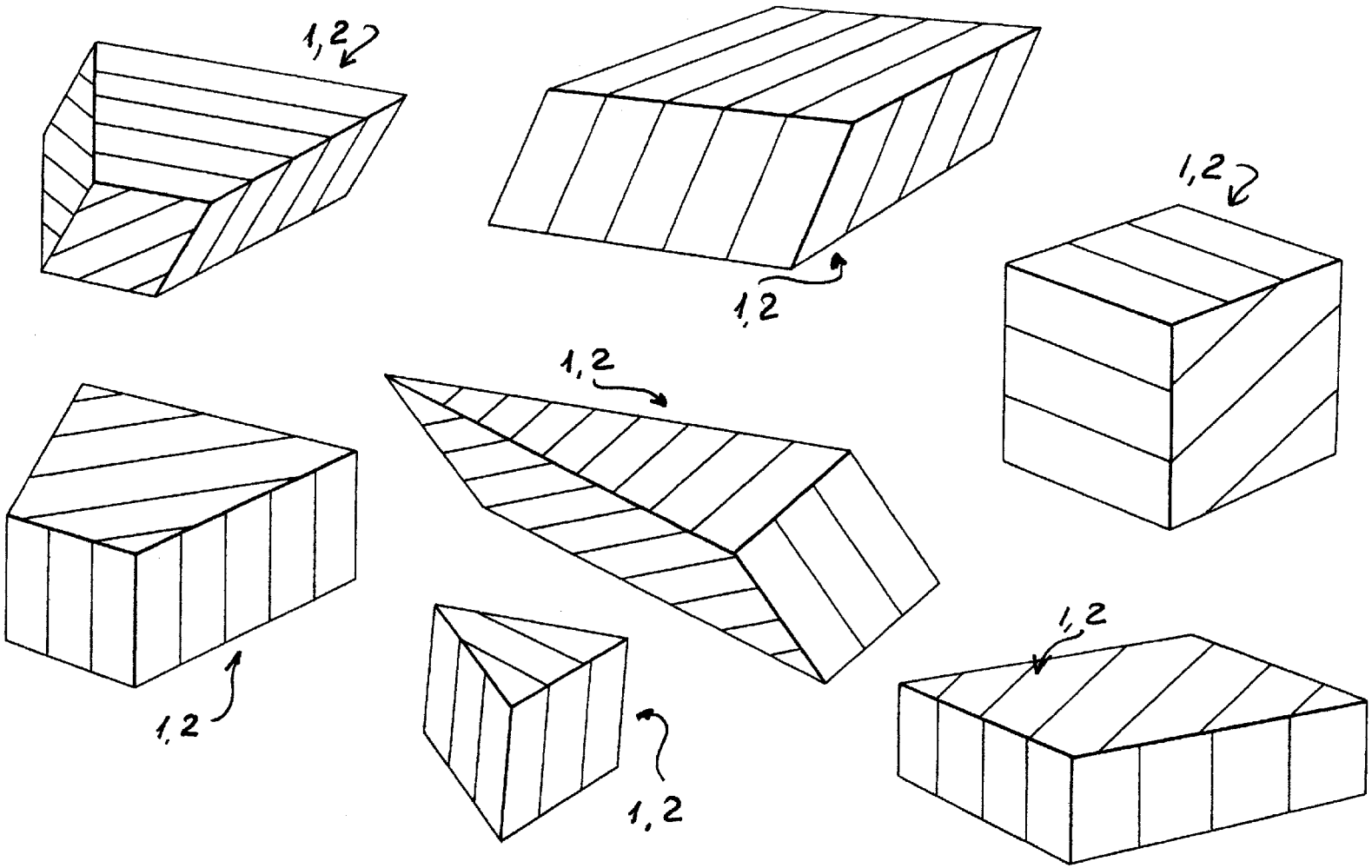
FIG. 9 is a view showing different shapes of the inventive elements.

As shown in several figures, in particular in FIG. 9 of the drawings, the elements 1 and 2 can be formed as prisms with four sides, three sides, or truncated. The bases of the elements 1 and 2 can have a shape of four-cornered surfaces and/or triangles with unequal sides. Preferably, they can have the shape of four-cornered surfaces and/or triangles with equal sides. The side surfaces of the prisms with four sides or three sides can be formed as rectangles and/or parallelograms, and the triangular surfaces can be formed with equal or unequal angles between the edges. The flexible plates 3 and the rigid projections 4 are arranged on the surfaces of the prism parallel to one another.

The flexible plates 3 and the rigid projections 4 can extend parallel, perpendicular or at different angles relative to the edges of the surfaces. They can be formed on one, two or more surfaces, or on all surfaces.

When the elements 1 and 2 are being connected with one another, the flexible tongues 3 and the rigid projections 4 of one of the elements are introduced into the gaps between the flexible tongues 3 and the rigid projections 4 of the other element. During movement of the flexible tongues of the element 1 in the gaps 5 of the element 2, due to the interaction with the rigid projection 4 the flexible tongues 10 are bent and assume the shape of the profile of the side surface 6. Since the flexible tongues 3 are arranged in one gap in a pair, interengage with one another and the side surfaces 6 of the rigid projections 8 so as to embrace them from both sides, they are deformed uniformly, compensate the stresses, and therefore provided reliable interengagement and prevent displacement of the elements relative to one another. The shape of the side surfaces 6 provides such a bending of the flexible plates 3, which counteracts the disassembly of the elements 1 and 2 due to a clamp shape, with an increase of the friction force in the connection. For connecting the elements with one another, it is not necessary to exactly align the flexible tongues 3 with the corresponding gaps 5, since the width of the gap is 1.5–2.5 greater than the thickness of the flexible plates 3, which increases the speed and convenience of the assembly.

The arrangement of the tongues and projections on all sides of the elements and at different angles to the edges, and also the use of differently shaped elements increases the versatility of the constructions and allows creation of complicated compositions.

The shape of the connecting elements optimizes the technology of manufacture of the elements in a multi-nest dye with two separation surfaces.

Figure 1A:
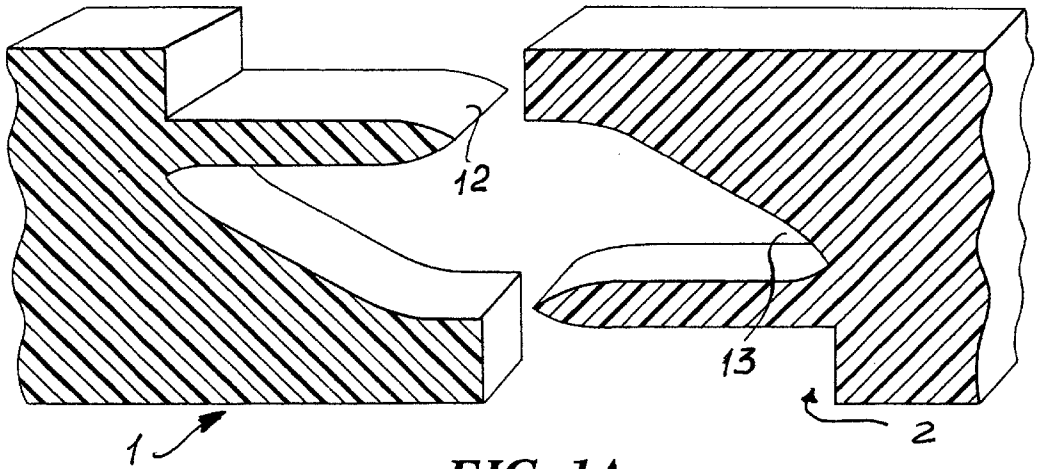
FIGS. 1*a* and 2*a* are views substantially corresponding to the views of FIGS. 1 and 2 but showing a further modification of the present invention.
Figure 2A:
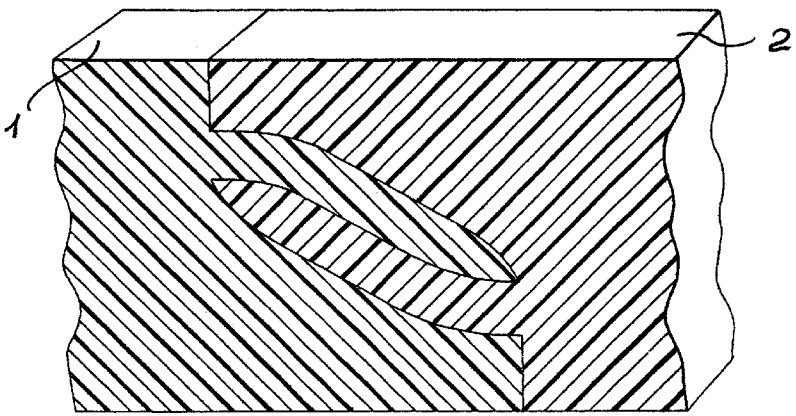

As shown in FIGS. 1*a* and 2*a*, the free ends 12 of the flexible tongues and the bottoms 13 of the gaps can be pointed, to additionally increase the interengagement.

Figure 3:
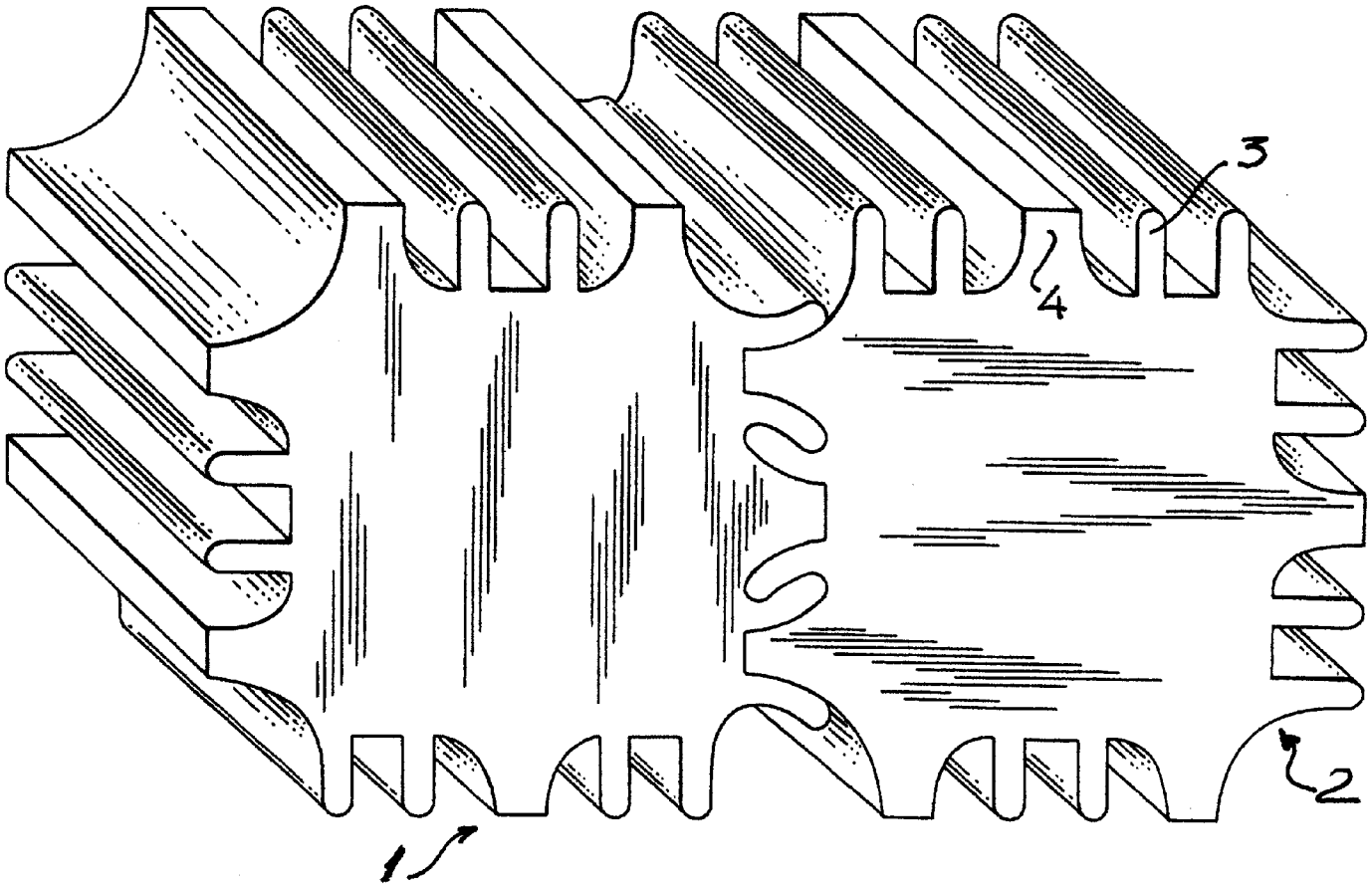
FIG. 3 is a view showing the elements connected with one another in accordance with a further embodiment of the present invention.

As shown in FIG. 3, the flexible tongues 3 and the rigid projections 4 can be formed on four sides of the elements and alternate with one another in different sequences. Here the rigid projection 4 is located within two pairs of the flexible tongues 3.

Figure 4A:
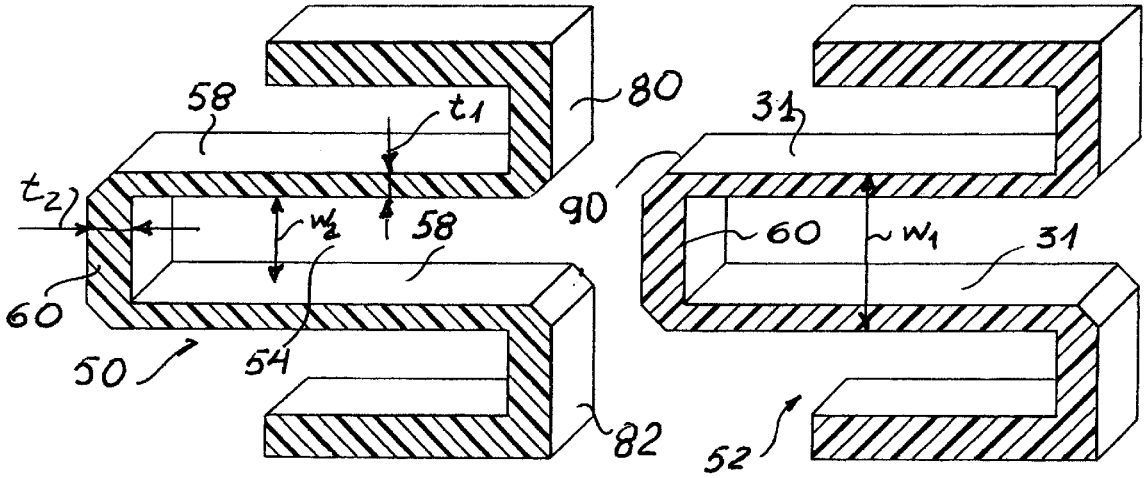
FIGS. 4*a* and 4*b* are views showing the elements in accordance with a further embodiment of the present invention, in not connected and in connected condition.
Figure 4B:
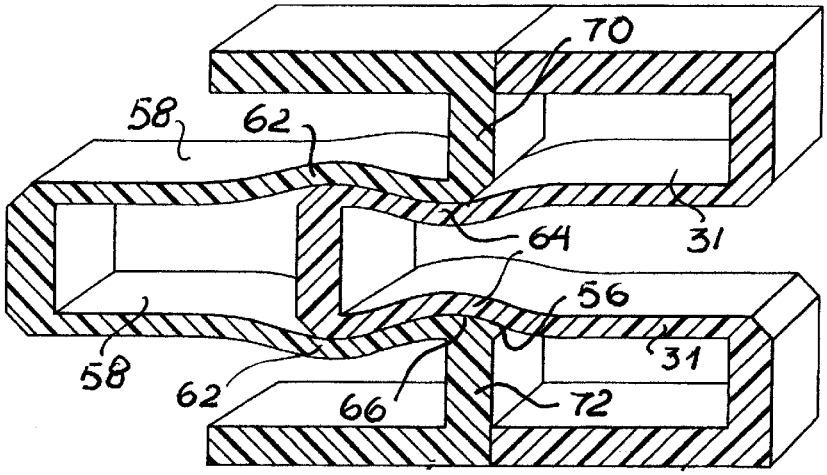

As can be seen from FIGS. 4*a*, 4*b*, the elastic tongues 3' can be arranged in pairs and connected with one another by a partition 14. They are stackable in one another during assembly of the elements 1 and 2 with one another.

As shown in these figures, a coupling assembly includes an insert element 52 and a receiving element 50, which are preferably identical. Coupling of the insert and receiving element is a result of geometric configuration and deformation of these elements, as shown in FIGS. 4*a* and 4*b*. Particularly, each of the receiving and insert elements 50, 52 has a respective central portion of substantially a U-shaped cross section which includes elongated side webs of flexible material 58, 31 and a bottom web or partition 60, which bridges the webs. Preferably, the side webs each have a thickness $t_1$ which is smaller than a thickness $t_2$ of the bottom web part 60, as shown in FIG. 4*a*, to allow the webs to yield to a force exerted by the bottom web 60 and sufficient to displace these webs laterally outwardly, as shown in FIG. 4*b*. To provide this force, an outer width of the central part $w_1$ is configured during coupling of elements 50, 52 to be greater than an inner width $w_2$ of an opening 54 of the receiving element 50. Upon applying an external force, the bottom web 60 and part of the side webs of the insert element 52 are introduced into the opening 54 of the receiving element 50 and form outwardly curved regions 62 along the side webs 58 of the receiving element 50. Also, the insert element 52 is deformed so that its side webs 31 are provided with curved regions 64 extending complementary to and overlapping the regions 62 to provide reliable engagement between the elements 50, 52. To facilitate insertion, the bottom webs 60 have each a slanted front edge 90. The bottoms 56 of the regions 64 are juxtaposed with partitions or bottom webs 66 of side connecting protrusions 70, 72 (FIG. 4*b*).

Bottom webs 66 and outward webs 80, 82 of the protrusions 72, 74 are thicker than the side webs 58 and 31 of the central portions and are configured to balance the outwardly directed force exerted by the insert element 52. Upon insertion, the outward webs 80, 82, configured to be shorter than the side webs 58, 31 of the central portions of the insert element, abut the bottom webs 66 of the side protrusions 72, 74 of the receiving element 50.

Figure 5:
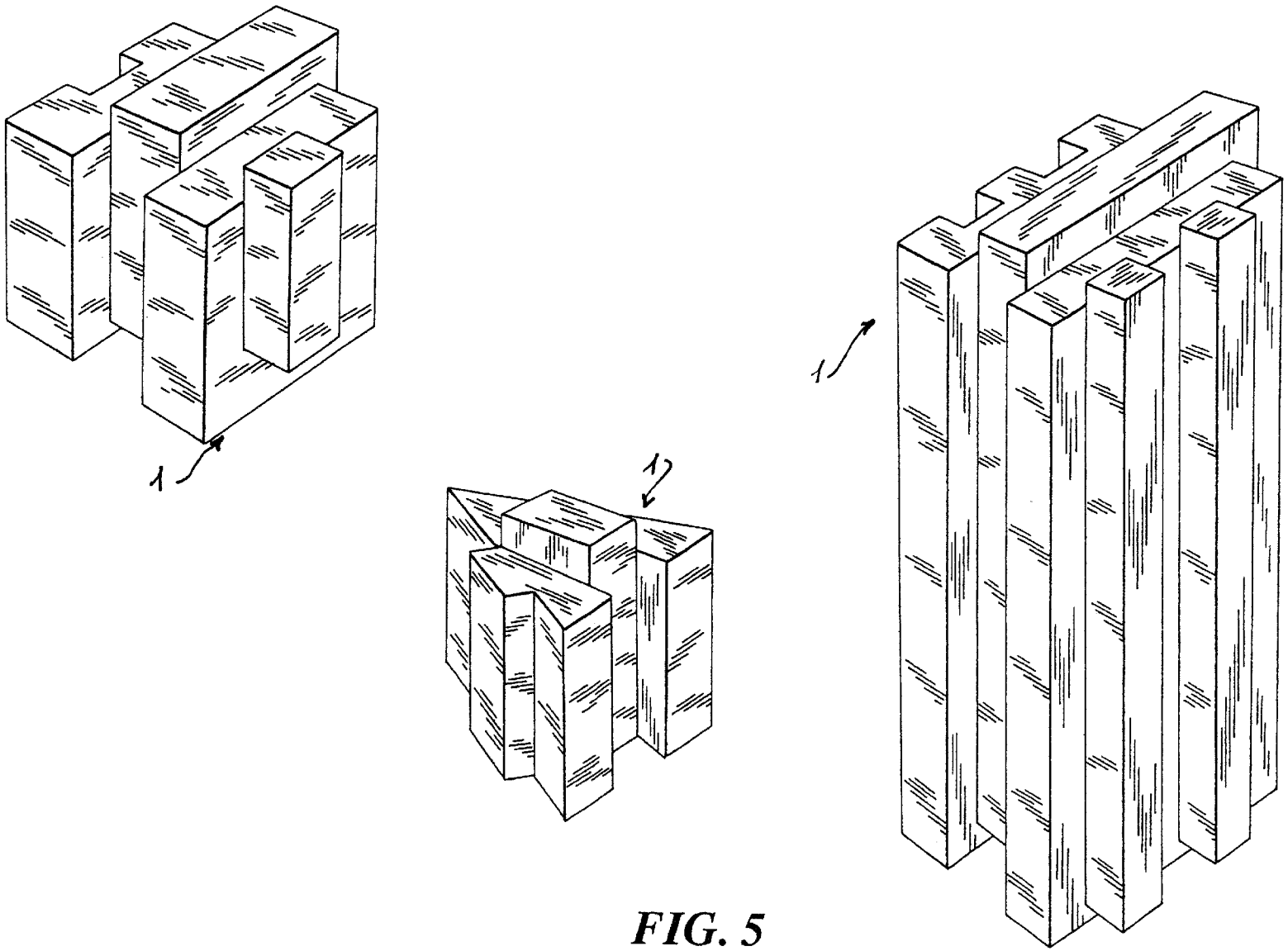
FIG. 5 is a view showing a further modification of the inventive element.
Figure 5A:
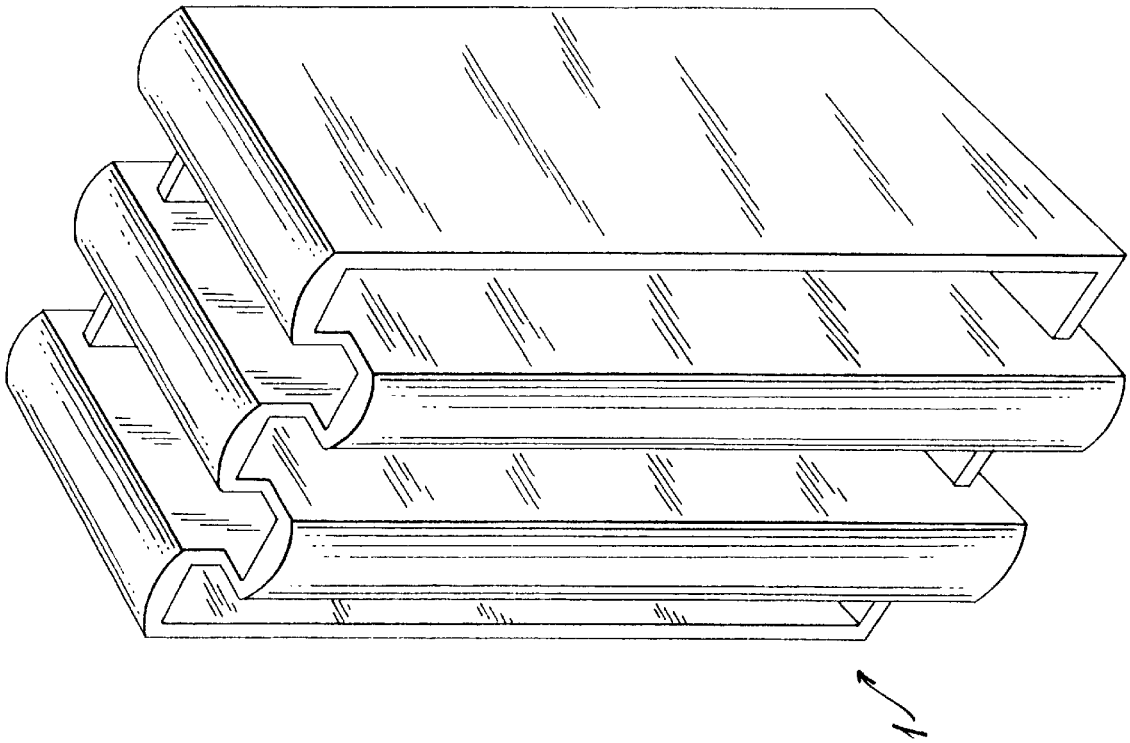
Figure 5A:
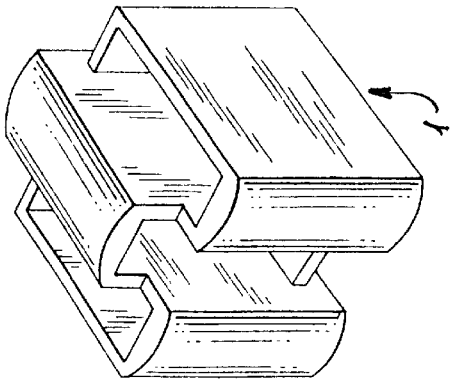

As can be seen from FIG. 5, the elements 1 and 2 can have different shapes.

Figure 6:
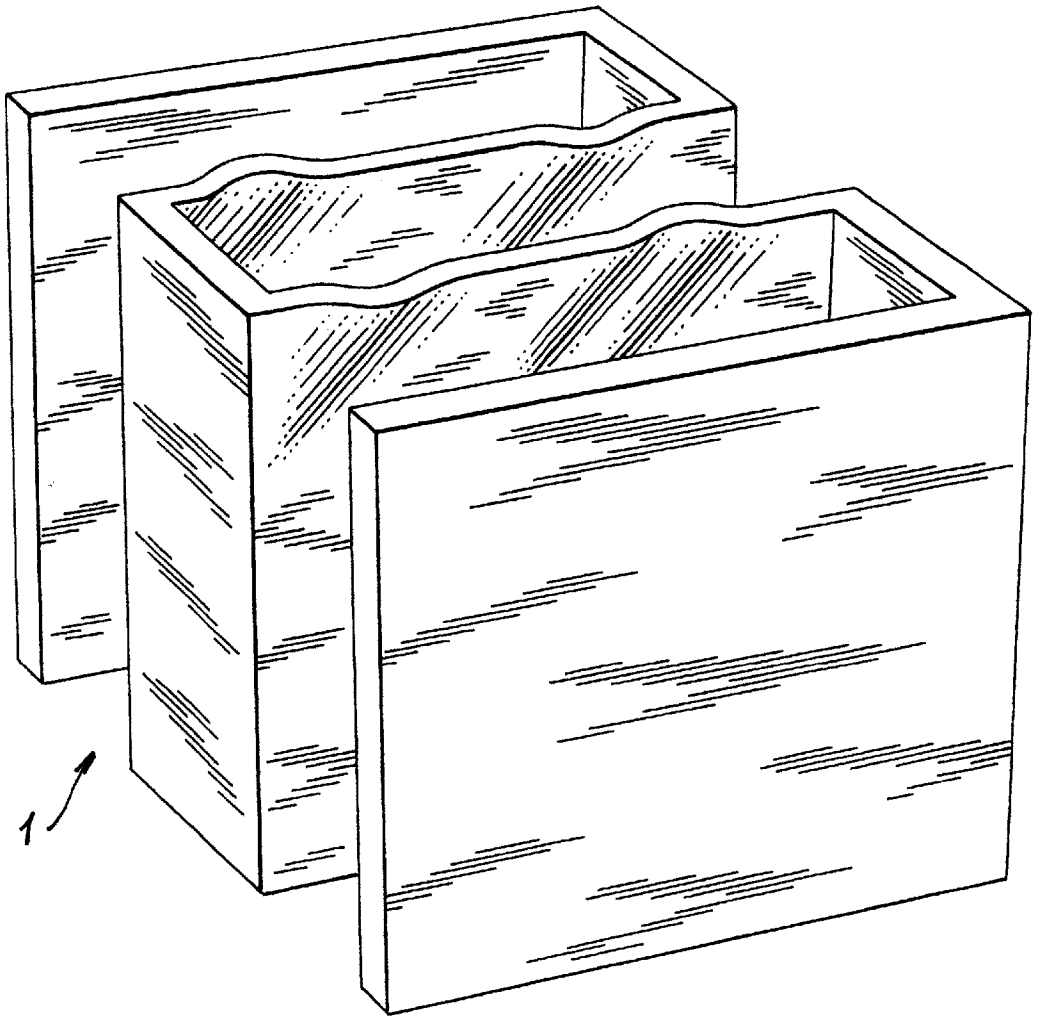
FIG. 6 is a view showing still a further modification of the inventive element.

FIG. 6 shows a further modification of the invention. Here the elastic tongues 3" has a wavy configuration, or a plurality of bends to provide compensation during connection of the elements with one another, in their assembled condition.

FIG. 7 shows another embodiment of the inventive elements. Here the elements also have the elastic tongues 3 and the rigid projections 4 with gaps therebetween. The tongues in the projections are formed on at least four surfaces of each element. The elements are hollow, and their inner hollows are identified with reference numeral 15. This reduces the weight and the material used for the elements.

Figure 8:
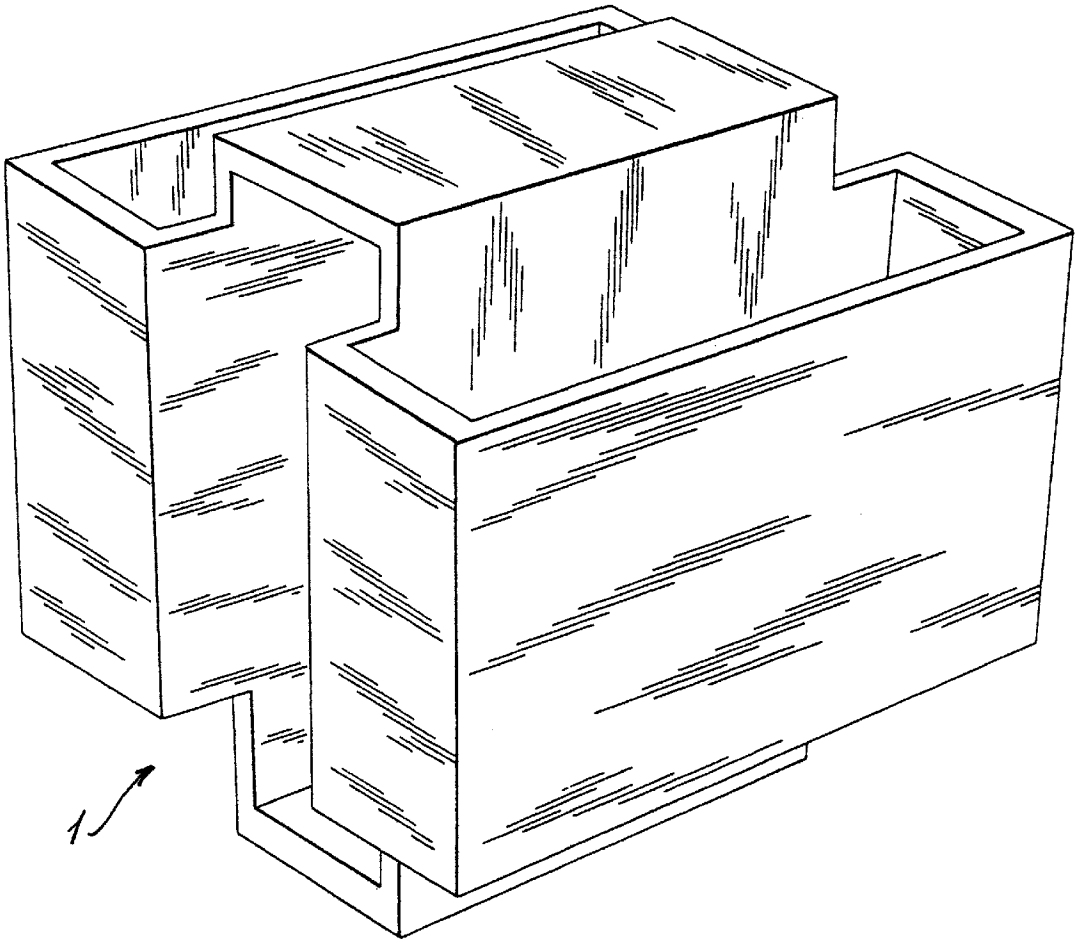
FIG. 8 is a view showing a further element in accordance with the present invention.
Figure 8A:
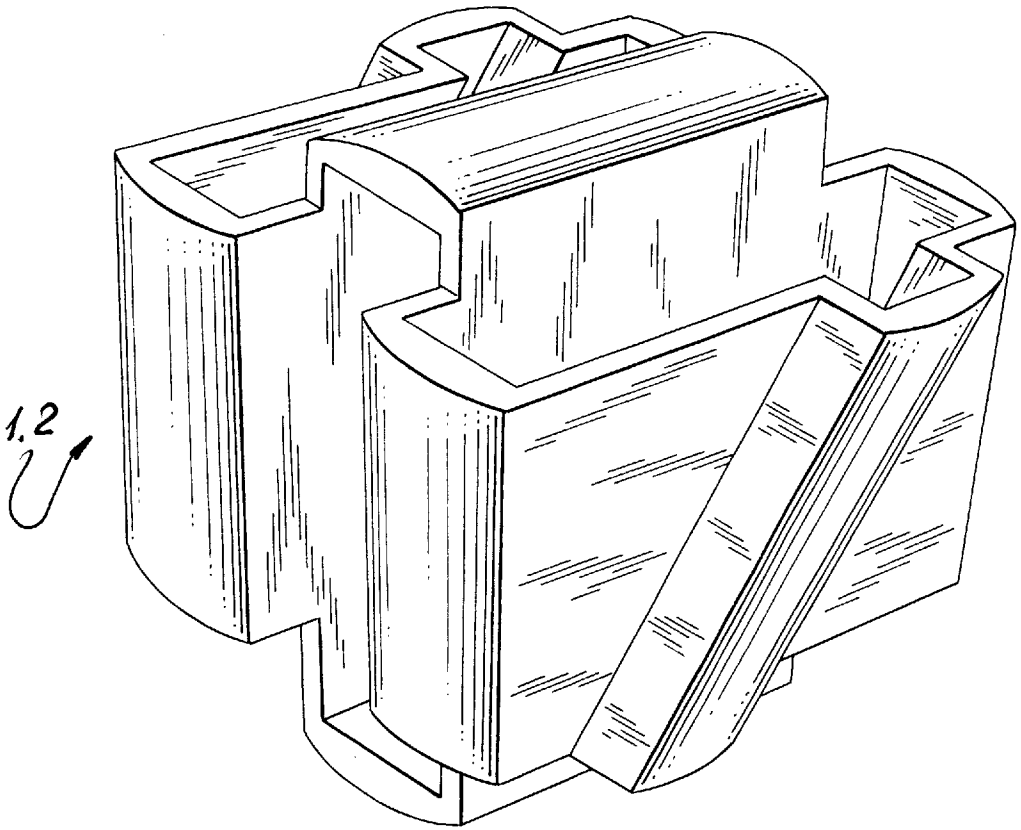

Finally, FIG. 8 shows an element in which the elastic tongues 3" have connecting parts 16 which are rigid.

It will be understood that each of the elements described above, or two or more together, may also find a useful application in other types of constructions differing from the types described above.

While the invention has been illustrated and described as embodied in element of erection set, and erection set provided therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An erection set comprising a plurality of first and second structural elements each extending along a respective longitudinal axis between leading and trailing ends, the trailing end of the first element being configured to receive the leading end of the second element in an engaging position, wherein the leading end of the second element is deformed radially inwards towards the longitudinal axis to have a concave end region provided with a nadir, and the trailing end of the first element is deformed radially outwards from the longitudinal axis to have a convex end region provided with an apex, which is spaced axially from the nadir of the second element, the convex and concave end regions of the first and second elements having first and second portions, respectively, juxtaposed with and extending complementary to one another between the apex and nadir to prevent relative displacement of the first and second elements in the engaging position thereof.

2. The erection set of claim 1, wherein the first and second elements each have a respective central portion having a pair of spaced flexible side webs extending parallel to one another in a disengaging position of the elements and having free ends defining the trailing end of the elements, and a bottom web bridging ends the flexible side webs opposite to the free ends and defining the leading end of the elements, the central portions of each element being wider than a distance between the flexible side webs and configured so that when the leading end of the second element is received in the trailing end of the first element, the concave end region is formed.

3. The erection set of claim 2, wherein each of the free ends of the flexible side webs of the central portions has an outward angled portion extending laterally outwards from a respective free end and configured to have a respective bottom web, which bridges the free ends of the flexible side webs and an outer web of the angled portion extending parallel to the side webs of the central portion.

4. The erection set of claim 3, wherein the bottom webs of the central and outward angled portions of the first an second elements and the outer webs of the outward angled portions are thicker than the flexible side webs of the central portion.

5. The erection set of claim 4, wherein the bottom webs of the outward angled portions of the first element is juxtaposed with and presses upon the leading end of the second element to form the convex end region thereof in the engaging position.

6. The erection set of claim 1, wherein the leading ends of the first and second elements are spaced from one another in the engaging position.

7. The erection set of claim 3, wherein the outer webs of the outward angled portions of the first and second elements are configured to press against an outer surface of the bottom webs of the outward angled portions in the engaging position of the elements.

8. The erection set of claim 2, wherein the bottom webs of the first and second elements have opposite ends slanted to facilitate insertion of the first element into the second element.

* * * * *